US009353612B2

(12) United States Patent
Batarseh

(10) Patent No.: US 9,353,612 B2
(45) Date of Patent: May 31, 2016

(54) ELECTROMAGNETIC ASSISTED CERAMIC MATERIALS FOR HEAVY OIL RECOVERY AND IN-SITU STEAM GENERATION

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 119 days.

(21) Appl. No.: 14/147,914

(22) Filed: Jan. 6, 2014

(65) Prior Publication Data

US 2015/0021013 A1 Jan. 22, 2015

Related U.S. Application Data

(60) Provisional application No. 61/847,681, filed on Jul. 18, 2013.

(51) Int. Cl.

| | |
|---|---|
| ***E21B 43/24*** | (2006.01) |
| ***E21B 36/00*** | (2006.01) |
| ***H05B 6/10*** | (2006.01) |

(Continued)

(52) U.S. Cl.

CPC ..... *E21B 43/24* (2013.01); *E21B 43/2401* (2013.01); *E21B 43/2406* (2013.01); *H01Q 1/04* (2013.01); *H05B 6/108* (2013.01); *H05B 6/36* (2013.01)

(58) Field of Classification Search

CPC ..... E21B 43/2401; E21B 36/04; E21B 43/24; E21B 43/2408; E21B 43/16; E21B 43/17; E21B 43/247; E21B 43/305; E21B 36/005; E21B 36/006; H05B 2214/03; H05B 6/80; H05B 6/62; H05B 6/108; H01Q 1/04

See application file for complete search history.

(56) References Cited

U.S. PATENT DOCUMENTS

| | | | |
|---|---|---|---|
| 2,757,738 | A | 8/1956 | Ritchey |
| 4,140,179 | A | 2/1979 | Kasevich et al. |
| 4,508,168 | A | 4/1985 | Heeren |

(Continued)

FOREIGN PATENT DOCUMENTS

| | | | |
|---|---|---|---|
| FR | 2274334 | A1 | 1/1976 |
| FR | 2274334 | B1 | 8/1979 |

(Continued)

OTHER PUBLICATIONS

PCT International Search Report and The Written Opinion; dated Mar. 13, 2015; International Application No. PCT/US2014/046831; International File Date: Jul. 16, 2014.

(Continued)

*Primary Examiner* — Doug Hutton, Jr.
*Assistant Examiner* — Charles R Nold
(74) *Attorney, Agent, or Firm* — Bracewell LLP; Constance G. Rhebergen; Kevin R. Tamm

(57) ABSTRACT

The disclosure provides a downhole tool, and method of using the downhole tool, for enhancing recovery of heavy oil from a formation. A method for enhancing recovery of heavy oil from a formation includes placing a downhole tool in a first wellbore. The downhole tool has an outer core having at least one ceramic portion and at least one electromagnetic antenna located within the outer core. Electromagnetic radiation is emitted from the at least one electromagnetic antenna to heat the at least one ceramic portion.

19 Claims, 5 Drawing Sheets

(51) Int. Cl.

| | |
|---|---|
| ***H01Q 1/04*** | (2006.01) |
| ***H05B 6/36*** | (2006.01) |

(56) References Cited

U.S. PATENT DOCUMENTS

| | | | | |
|---|---|---|---|---|
| 4,553,592 | A | 11/1985 | Looney et al. | |
| 4,620,593 | A | 11/1986 | Haagensen | |
| 5,065,819 | A | 11/1991 | Kasevich | |
| 6,112,808 | A | 9/2000 | Isted | |
| 7,441,597 | B2 | 10/2008 | Kasevich | |
| 7,875,120 | B2 | 1/2011 | Considine et al. | |
| 8,210,256 | B2 | 7/2012 | Bridges | |
| 8,453,739 | B2 | 6/2013 | Parsche | |
| 8,485,252 | B2 | 7/2013 | De Rouffignac et al. | |
| 2008/0230219 | A1* | 9/2008 | Kaminsky | 166/248 |
| 2009/0250204 | A1 | 10/2009 | Harris | |
| 2010/0132921 | A1 | 6/2010 | Moskal et al. | |
| 2010/0219107 | A1 | 9/2010 | Parsche | |
| 2011/0061859 | A1* | 3/2011 | Crihan | 166/247 |
| 2012/0067580 | A1* | 3/2012 | Parsche | 166/302 |
| 2012/0073798 | A1 | 3/2012 | Parsche et al. | |
| 2012/0118565 | A1 | 5/2012 | Trautman et al. | |
| 2012/0125609 | A1 | 5/2012 | Parsche | |
| 2012/0205109 | A1* | 8/2012 | Burnham et al. | 166/302 |
| 2012/0305239 | A1 | 12/2012 | Sultenfuss et al. | |
| 2013/0199774 | A1* | 8/2013 | Sultenfuss et al. | 166/248 |
| 2014/0090834 | A1* | 4/2014 | Sultenfuss et al. | 166/248 |
| 2014/0301017 | A1 | 10/2014 | Diehl et al. | |

FOREIGN PATENT DOCUMENTS

| | | | |
|---|---|---|---|
| WO | 2010023519 | A1 | 3/2010 |
| WO | 2012038814 | A2 | 3/2012 |
| WO | 2013060610 | A1 | 5/2013 |

OTHER PUBLICATIONS

Kasevich, R. S., et al.; Pilot Testing of a Radio Frequency Heating System for Enhanced Oil Recovery from Diatomaceous Earth; SPE Annual Technical Conference and Exhibition; Sep. 25-28, 1994; New Orleans, LA; Society of Petroleum Engineers, Inc.

Okassa, F., et al.; A Nonconventional EOR Technology Using RF/MW Heating Coupled With a New Patented Well/Reservoir Interface; SPE Annual Technical Conference and Exhibition; Sep. 19-22, 2010; Florence, Italy; Society of Petroleum Engineers, Inc.

* cited by examiner

ELECTROMAGNETIC ASSISTED CERAMIC MATERIALS FOR HEAVY OIL RECOVERY AND IN-SITU STEAM GENERATION

CROSS REFERENCE TO RELATED APPLICATION

This application claims priority to and the benefit of U.S. Provisional Application Ser. No. 61/847,681 filed Jul. 18, 2013 the full disclosure of which is hereby incorporated by reference herein for all purposes.

BACKGROUND

1. Field of the Disclosure

Generally, this disclosure relates to enhanced oil recovery. More specifically, this disclosure relates to electromagnetic assisted ceramic materials for heavy oil recovery and the generation of steam in-situ.

2. Background of the Disclosure

Enhanced oil recovery relates to techniques to recover additional amounts of crude oil from reservoirs. Enhanced oil recovery focuses on recovery of reservoir heavy oil and aims to enhance flow from the formation to the wellbore for production. To produce heavy oil from the targeted formation, it is greatly beneficial to reduce the viscosity of the heavy oil in the formation. In many instances, heat is introduced to the formation to lower the viscosity and allow the oil to flow. Among the ways increased temperature can be introduced into a formation are steam injection, in-situ combustion, or electromagnetic heating including microwave.

Steam injection is the most common thermal recovery method practice currently used worldwide. Steam Assisted Gravity Drainage (SAGD) is a form of steam injection method and configuration where two parallel horizontal wells (upper and lower) are drilled to the target zone. The upper well issued for steam injection to deliver thermal energy which raises reservoir temperature. This reduces the heavy oil viscosity and increases mobility, thus allowing the oil to drain and flow downward to produce via the lower horizontal well (producer) due to gravity effect. Improved systems for in-situ steam generation are needed to further improve these types of enhanced oil recovery methods.

Electromagnetic wave technology has potential in heavy oil recovery. Prior attempts at using electromagnetic wave technology have targeted the use of electromagnetic downhole with limited success due to limited heat penetration depth (such as a few feet near the wellbore) and low efficiency in generating enough energy for commercial production.

SUMMARY

In one aspect, the disclosure provides a downhole tool for enhancing recovery of heavy oil from a formation. The downhole tool includes an outer core comprising at least one ceramic portion and at least one solid ceramic portion. The downhole tool further includes at least one electromagnetic antenna located within the outer core. The at least one electromagnetic antenna is operable to emit electromagnetic radiation that is operable to heat the mesh and solid ceramic portions.

In another embodiment of the current disclosure, a downhole tool for enhancing recovery of heavy oil from a formation includes an inner core that is operable to allow the flow of fluid. The downhole tool further includes an outer core having at least one mesh ceramic portion and at least one solid ceramic portion. At least one electromagnetic antenna disposed between the inner core and outer core. The at least one electromagnetic antenna is operable to emit electromagnetic radiation that is operable to heat the at least one mesh ceramic portion and at least one solid ceramic portion.

In another aspect, the disclosure provides a method for enhancing recovery of heavy oil from a formation, including placing a downhole tool in a first wellbore. The downhole tool has an outer core having at least one ceramic portion and at least one electromagnetic antenna located within the outer core. Electromagnetic radiation is emitted from the at least one electromagnetic antenna to heat the at least one ceramic portion.

In another embodiment of the current disclosure, a method for enhancing recovery of heavy oil from a formation includes placing a downhole tool in a wellbore. The downhole tool has an inner core that is operable to allow the flow of fluid, an outer core comprising at least one mesh ceramic portion and at least one solid ceramic portion, and at least one electromagnetic antenna disposed between the inner core and outer core. Electromagnetic radiation is emitted from the at least one electromagnetic antenna. The at least one mesh ceramic portion and the at least one solid ceramic portion are heated to a temperature higher than the boiling point of a fluid. The fluid is injected into the inner core. Fluid flows from the inner core through the at least one mesh ceramic portion to the formation. The fluid is converted to steam as it flows through the at least one mesh ceramic portion.

DETAILED DESCRIPTION OF THE DISCLOSURE

Although the following detailed description contains many specific details for purposes of illustration, it is understood that one of ordinary skill in the art will appreciate that many examples, variations, and alterations to the following details are within the scope and spirit of the disclosure. Accordingly, the exemplary embodiments of the disclosure described herein and provided in the appended figures are set forth without any loss of generality, and without imposing limitations, on the claimed embodiments of this disclosure.

In one aspect, the disclosure provides a downhole tool for enhancing recovery of heavy oil from a formation. The downhole tool an outer core comprising at least one ceramic portion. The downhole tool further includes at least one electromagnetic antenna disposed within the outer core. The at least one electromagnetic antenna is operable to emit electromagnetic radiation that is operable to heat the ceramic material.

In another aspect, the disclosure provides a method for enhancing recovery of heavy oil from a formation that includes placing a downhole tool in a first wellbore. The downhole tool has an outer core having at least one ceramic portion and at least one electromagnetic antenna located within the outer core. Electromagnetic radiation is emitted from the at least one electromagnetic antenna to heat the at least one ceramic portion.

Figure 1A:
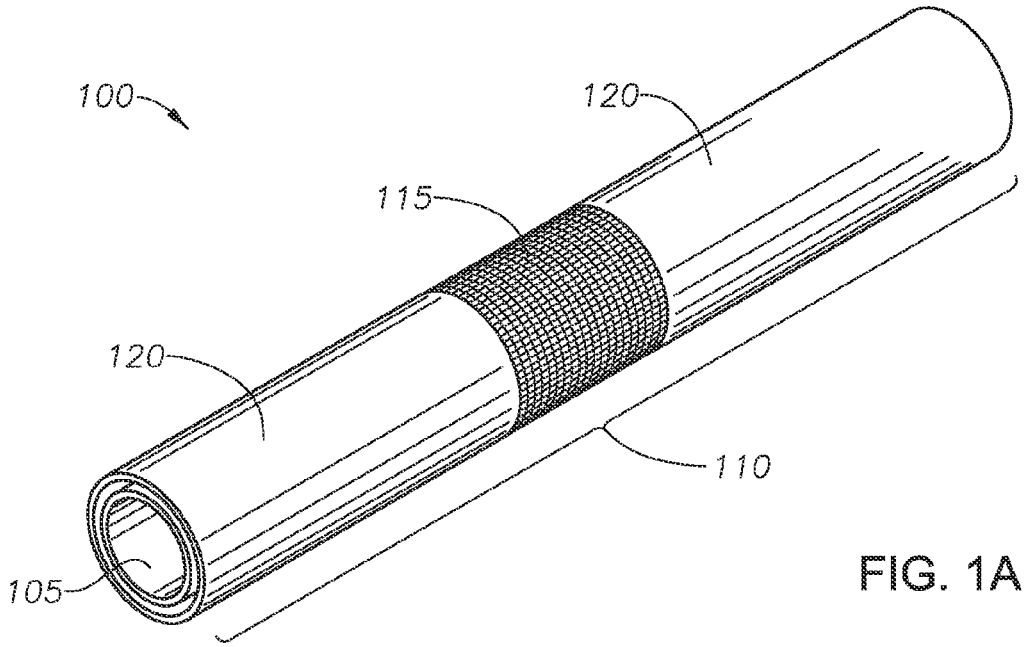
FIGS. 1A, 1B show an electromagnetic downhole tool according to an embodiment of the disclosure.
Figure 1B:
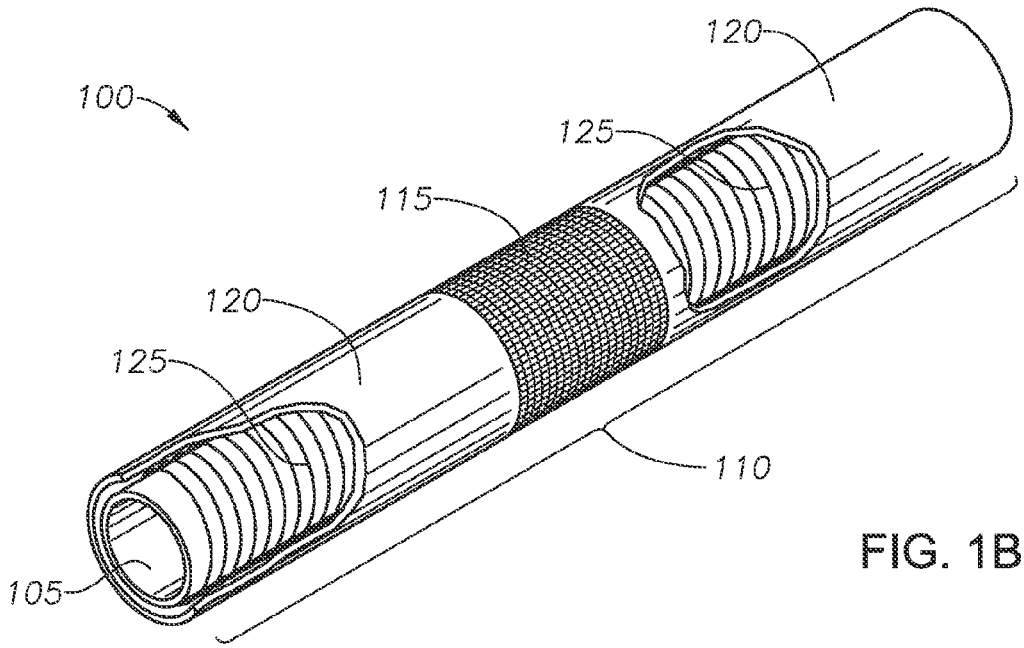
Figure 1C:
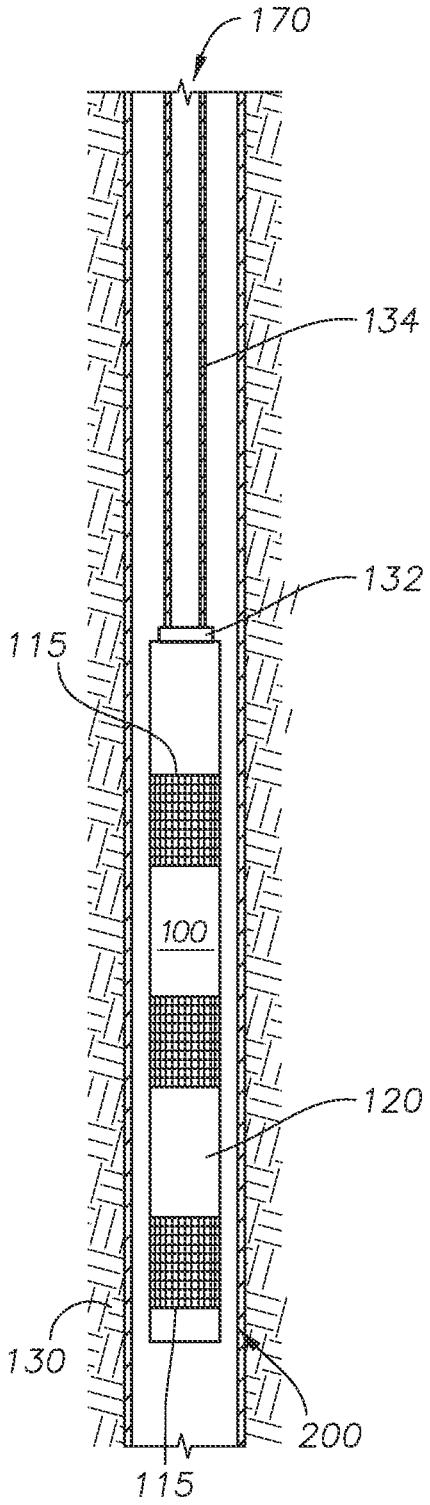
FIG. 1C, shows a wellbore with the electromagnetic downhole tool of FIGS. 1A and 1B according to an embodiment of the disclosure.

FIGS. 1A-1C show an embodiment of the present disclosure. As shown, downhole tool 100 has an inner core 105 that is operable to allow the flow of fluid. The downhole tool 100 also includes an outer core 110 comprising at least one mesh ceramic portion 115 and at least one solid ceramic portion 120. The downhole tool 100 further includes at least one electromagnetic antenna 125 disposed between the inner core 105 and outer core 110.

Figure 2A:
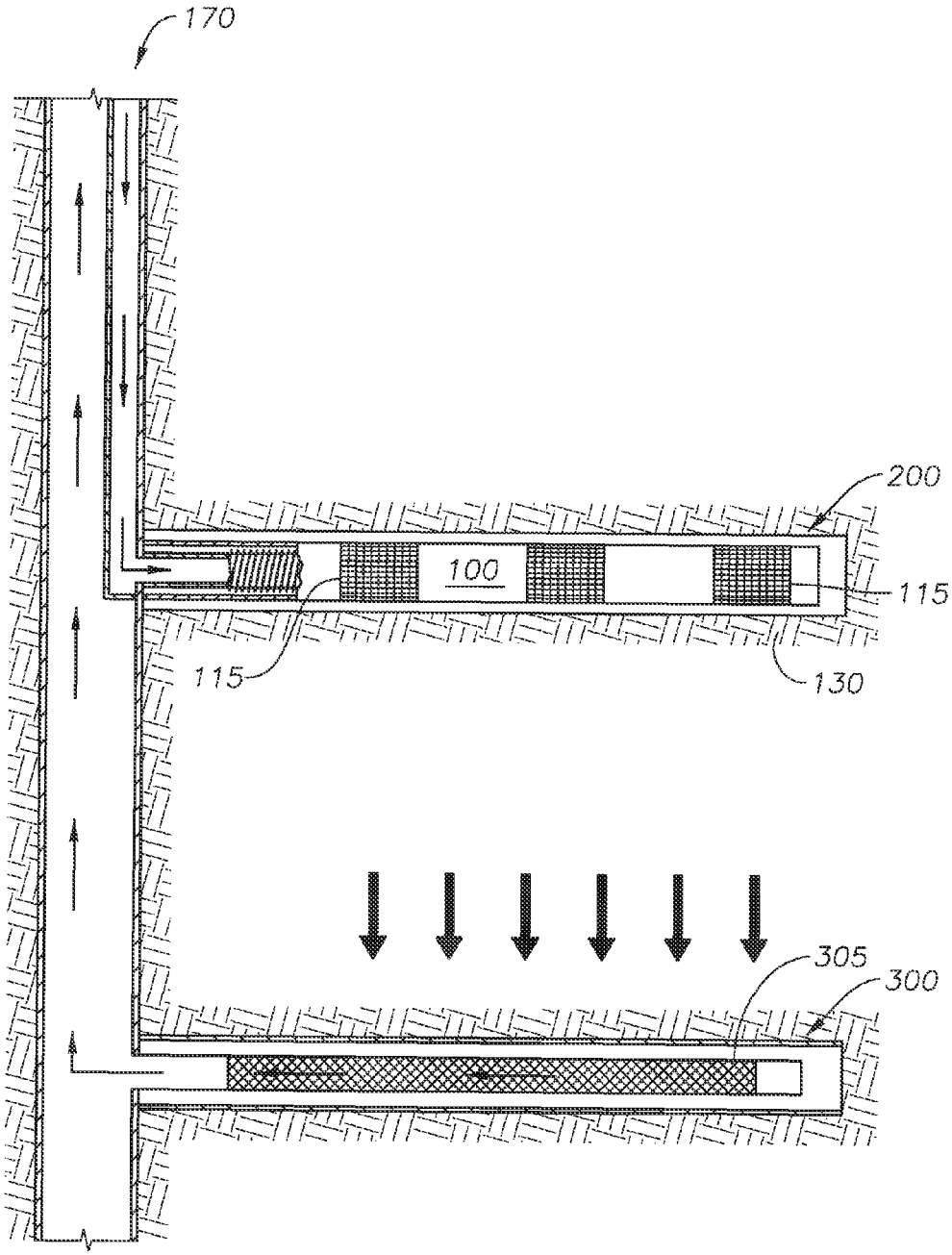
FIGS. 2A, 2B, and 2C show a wellbore with an apparatus according to embodiments of the disclosure.

In another aspect, the disclosure provides a method of using the downhole tool 100. The method includes placing the downhole tool 100 in a wellbore in a formation 130, as shown in FIGS. 1C and 2A. In the embodiment of FIG. 1C, the downhole tool 100 has both solid ceramic portions 120 and mesh ceramic portions 115, however in alternative embodiments, downhole tool 100 can have only solid ceramic portions 120, or can have only mesh ceramic portions 115. Downhole tool 100 has a connector 132 for attaching the downhole tool 100 to a string 134 so that downhole tool 100 can be removeably lowered into the borehole 200. Borehole 220 can be either a vertical borehole or a horizontal borehole. Downhole tool 100 can be lowered in to the borehole 200 by conventional means, such as on a wireline, coiled tubing, or a drill string. In the embodiment of FIG. 2A, the downhole tool 100 is instead integrally formed as a part of the well structure.

Electromagnetic radiation is emitted from the at least one electromagnetic antenna 125. The ceramic portions are heated to a temperature higher than the boiling point of a fluid. The downhole tool 100 can in this way be used as a source of heat. For example, a source of heat can be useful in raising the temperature of the formation to lower the viscosity of the heavy oil and allow the heavy oil to be more easily produced. In certain embodiments where the ceramic portion includes only solid ceramic portions 120, heat radiates from the downhole tool 100. In other embodiments where tool 100 has at least one mesh ceramic portion 115, fluid can be injected into the inner core 105 through the bore 170. Fluid is allowed to flow from the inner core 105 through the at least one mesh ceramic portion 115 to the formation 130. The fluid is converted to steam as it flows through the at least one mesh ceramic portion 115.

The mesh ceramic portion 115 and solid ceramic portion 120 of the downhole tool 100 can be made of the same or different materials. In general, the ceramic materials used for both the mesh and solid portions 115, 120 have unique characteristics. In particular, it is critical that the selected ceramic materials are operable to heat up when exposed to electromagnetic radiation. In some embodiments, the ceramic materials heat quickly. In some embodiments, the ceramic materials heat within minutes. In some embodiments, the ceramic materials heat in less than about 5 minutes. In some embodiments, the ceramic materials heat in less than about 3 minutes. In some embodiments, the ceramic materials include heat up ceramic materials obtained from Advanced Ceramic Technologies, such the CAPS, B-CAPS, C-CAS AND D-CAPS products. These products are generally natural clays that include silica, alumina, magnesium oxide, potassium, iron III oxide, calcium oxide, sodium oxide, and titanium oxide. In some embodiments, the ceramic materials can be heated to at least about 1000° C. when exposed to electromagnetic radiation from the at least one electromagnetic antenna 125. Additionally, in some embodiments, the ceramic materials are also moldable and can be formed in any shape and size needed for downhole use. In general, the ceramic material heats upon exposure to the electromagnetic radiation and thus heats the region of the formation 130 nearby. The heat penetration depth will be wider and deeper into the formation 130. The energy efficiency will improve as well.

The at least one mesh ceramic portion 115 is operable to allow for the flow of fluid from the inner core 105 to the formation 130. In some embodiments, the solid ceramic portion 120 can be fabricated as a solid porous ceramic portion to allow the flow fluids. When heated, the mesh ceramic portion 115 and solid porous ceramic portion 120 are operable to convert fluids to steam as the fluids pass through from the inner core 105 to the formation 130. The steam then heats the heavy crude oil and/or bitumen in the surrounding formation 130, reducing the viscosity of the heavy crude oil and/or bitumen, allowing it to flow for purposes of production.

The mesh ceramic portion 115 and solid porous ceramic portion 120 can be used to allow the reduced viscosity heavy oil to flow through from the formation 130 to the inner core 105 and be produced through the same wellbore. Thus, the tool 100 can be used for both stimulation and production. The solid ceramic portions 120 will act as a heat source for a any application in which heat is needed, for example for heating up the heavy oil, thus assisting in the reduction of the heavy oil viscosity and allowing it to flow and be produced.

The fluid used in embodiments of the present disclosure can be any fluid that can be converted to steam by the ceramic portions and used to reduce the viscosity in the formation 130 near the ceramic portions. In some embodiments, the fluid is water.

The at least one electromagnetic antenna 125 can be any antenna configured for use downhole and operable to emit electromagnetic radiation frequency ranges that will heat the at least one mesh ceramic portion 115 and at least one solid ceramic portion 120. In some embodiments, the electromagnetic radiation frequency ranges from 300 MHz to 300 GHz. In some embodiments, the at least one electromagnetic antenna 125 will be excited based on signals from the surface. In some embodiments, the at least one electromagnetic antenna 125 will be excited wirelessly. In some embodiments, the at least one electromagnetic antenna 125 will be hard wired. In some embodiments, the at least one electromagnetic antenna 125 continuously emits radiation. In some embodiments, the at least one electromagnetic antenna 125 emits radiation in an intermittent fashion. In further embodiments, the radiation is emitted 360 degrees, in all directions. Antennas for use in embodiments of the disclosure can be obtained from Communications & Power industries Corporate Headquarters, Palo Alto, Calif., and Stanford Linear Accelerator Center (SLAC) National Accelerator Laboratory, Palo Alto, Calif. Both of these entities manufacture microwave systems called Klystron, ranging in frequency from 0.5 GHz to 30 GHz and power output ranging from 0.5 to 1200 kW. Additionally, both entities manufacture models that produce continuous wave or pulsed products.

Figure 2B:
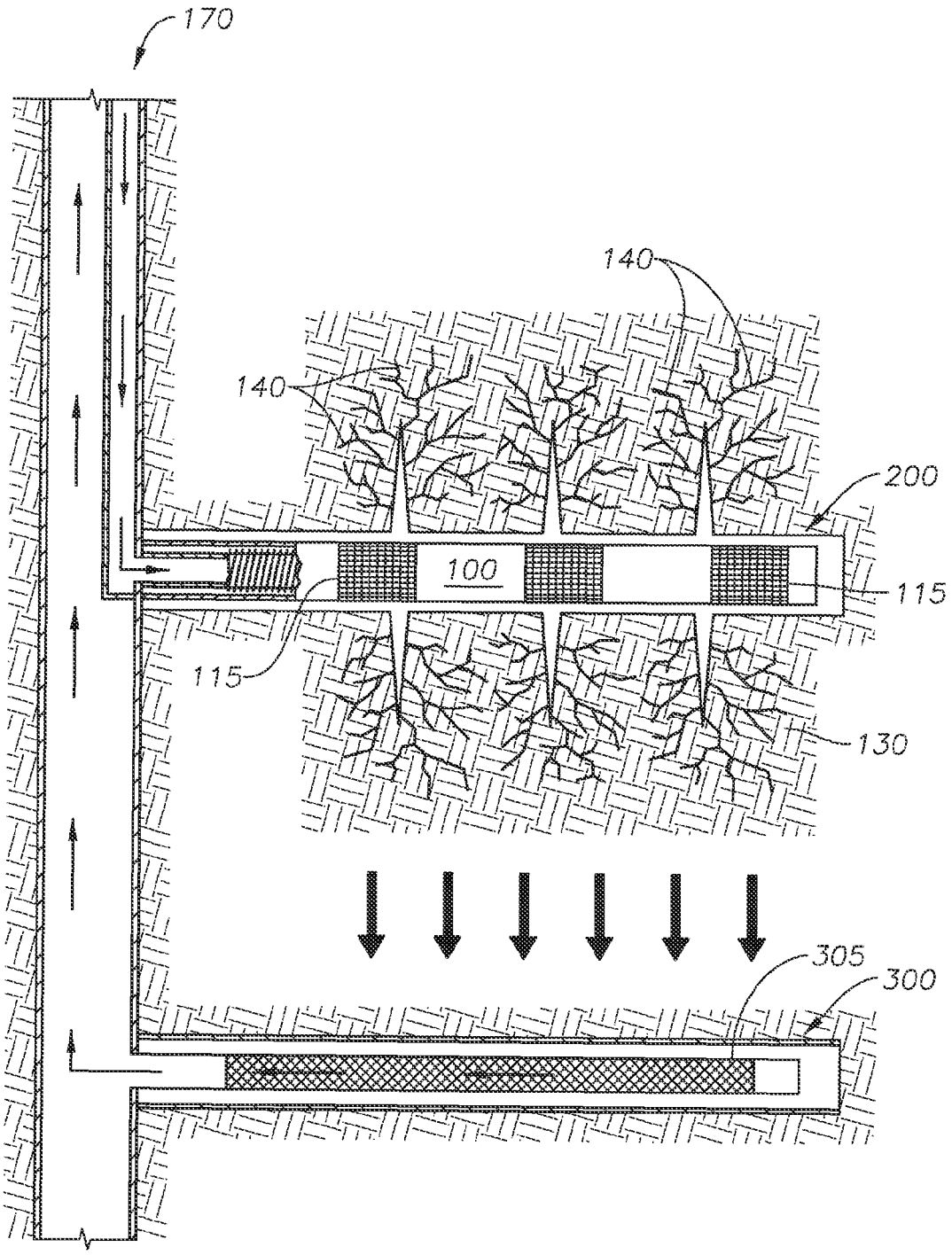
Figure 2C:
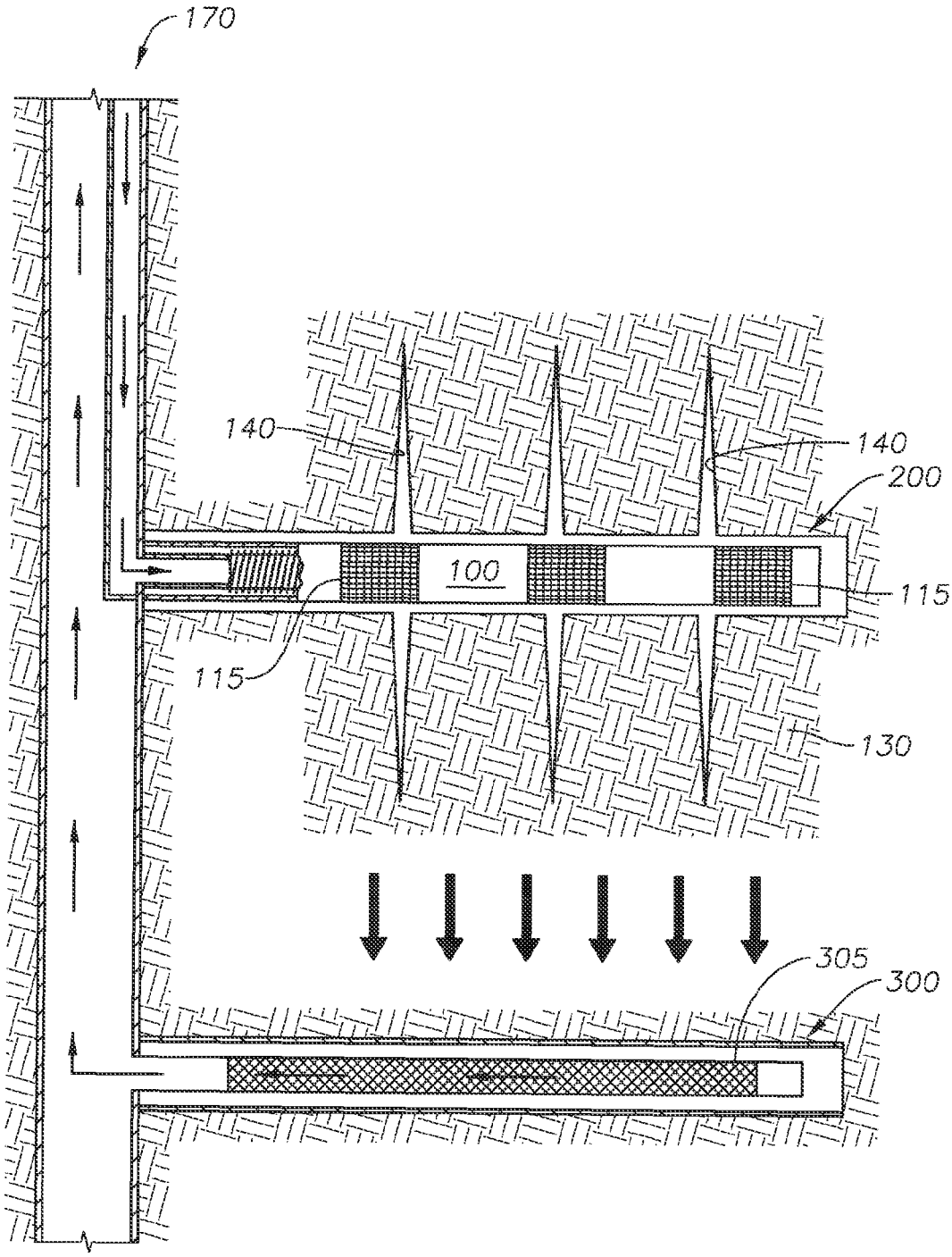

In some embodiments, a proppant including ceramic particles can also be injected into the inner core 105. As shown in FIG. 2B, the proppant including ceramic particles can be used in unconventional fracturing using a fine ceramic proppant, or, as shown in FIG. 2C, the proppant including ceramic particles can be used in conventional fracturing using ceramic proppant. The proppant including ceramic particles can flow from the inner core 105 through the at least one mesh ceramic portion 115 and into fractures 140 within the formation 130. Electromagnetic radiation is emitted from the at least one electromagnetic antenna 125, thus heating the ceramic particles in the proppant. The ceramic particles can include any of the same materials as can be used for the mesh ceramic portion 115 and solid ceramic portion 120. In some embodiments, the proppant including ceramic particles can be used to aid in fracturing of the formation 130.

In some embodiments, ceramic particles in a fluid carrier can also be injected into the inner core 105. The fluid carrier including ceramic particles can flow from the inner core 105 through the at least one mesh ceramic portion 115 into the formation 130. Electromagnetic radiation is emitted from the at least one electromagnetic antenna 125, thus healing the ceramic particles in the fluid carrier. The ceramic particles can include any of the same materials as can be used for the mesh ceramic portion 115 and solid ceramic portion 120. In some embodiments, the ceramic particles in a fluid carrier can be used to aid in fracturing of the formation 130.

The ceramic particles that are injected with the proppant or fluid carrier improve heat penetration and energy efficiency in the reservoir in conventional reservoir fractures, as the ceramic particles which are heated by electromagnetic radiation travel farther from the wellbore.

The particles range in sizes from micrometers to millimeters. Generally, the particles range from less than 2 micrometers to about 2500 micrometers. In some embodiments, the ceramic particles range in size from about 106 micrometers to 2.36 millimeter. In some embodiments, such as for fine ceramic particles, the ceramic particles are less than 2 micrometers. In some embodiments, the particles are of uniform size. In other embodiments, the particles are not of uniform size. The injection of ceramic particles is of particular use in tight formations.

As shown in FIG. 2, in some embodiments, a production tubing 305 is placed in a second wellbore 300 below the wellbore 200 containing the downhole tool 100. The steam that is produced when the fluid flows through the mesh ceramic portions 115 is then used to reduce the viscosity of heavy oil located in the formation 130 to produce reduced viscosity heavy oil. The reduced viscosity heavy oil drains, due to gravity, to a region containing the second wellbore 300. The reduced viscosity heavy oil enters the production tubing in the second wellbore 300 and is produced from the formation 130.

Heavy oil and tar sand are the main focus of the in-situ generated steam recovery processes described herein. Heavy oil is generally any type of crude oil that does not flow easily. The American Petroleum institute define heavy oil as API<22. Heavy oil can be defined as others as API<29 with a viscosity more than 5000. Heating the heavy oil reduces the viscosity and allows for production of the reduced viscosity heavy oil. Likewise, tar sands, or bituminous sands, are oil sands that include bitumen. Bitumen also has high viscosity and usually does not flow well unless heated or diluted through chemical means. In general, the embodiments of the present disclosure can be used in any formation 130 where reduced viscosity of oils in the formation 130 would enhance recovery efforts.

Combining ceramic materials with electromagnetic radiation technology allows for improved heat distribution, in-situ steam generation, and cost effective recovery methods. Embodiments of the disclosure provide for enhanced recovery of viscous heavy oil; in-situ steam generation; elimination of steam surface equipment such as steam pipes, steam transportation and handling equipment; reduction in costs due to in-situ generation of steam; improved safety, as there is no surface exposure to hot steam; improved recovery efficiency by improving heat penetration depth into the formation 130; and the use of a single well for injection and production.

Although the present disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an" and "the" include plural referents, unless the context clearly dictates otherwise.

Optional or optionally means that the subs described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

As used herein and in the appended claims, the words "comprise," "has," and "include" and all grammatical variations thereof are each intended to have an open, non-limiting meaning that does not exclude additional elements or steps.

What is claimed is:

1. A method for enhancing recovery of heavy oil from a formation, comprising the steps of:

suspending a downhole tool with a connector above a first wellbore;

removeably lowering the downhole tool in the first wellbore, the downhole tool comprising an outer core having at least one ceramic portion, the at least one ceramic portion comprising at least one mesh ceramic portion and at least one solid ceramic portion, the downhole tool further comprising an inner core, and at least one electromagnetic antenna disposed between the inner core and the outer core;

injecting fluid into the inner core of the downhole tool through the wellbore;

allowing the fluid to flow from the inner core through the at least one mesh ceramic portion of the downhole tool; and emitting electromagnetic radiation from the at least one electromagnetic antenna to heat the at least one ceramic portion.

2. The method of claim 1, further comprising converting the fluid from liquid to steam as it flows through the at least one mesh ceramic portion.

3. The method of claim 1, wherein the fluid is water.

4. The method of claim 1, wherein the step of heating the at least one ceramic portion comprises heating the at least one ceramic portion to at least about 1000° C.

5. The method of claim 1, wherein the step of emitting electromagnetic radiation comprises emitting electromagnetic radiation with frequency ranges from 300 MHz to 300 GHz.

6. The method of claim 1, the method further comprising:

converting the fluid from liquid to steam as it flows through the at least one mesh ceramic portion;

placing production tubing in a second wellbore below the first wellbore;

reducing the viscosity of heavy oil located in the formation with the steam to produce a reduced viscosity heavy oil;

draining the reduced viscosity heavy oil to a region containing the second wellbore; and flowing the reduced viscosity heavy oil into the production tubing to be produced from the formation.

7. The method of claim 1, wherein the at least one ceramic portion comprises silica, alumina, magnesium oxide, potassium, iron III oxide, calcium oxide, sodium oxide, and titanium oxide.

8. The method of claim 1, the method further comprising:

injecting a proppant comprising ceramic particles into the inner core; and heating the ceramic particles in the proppant with the electromagnetic radiation from the at least one electromagnetic antenna as the proppant flows from the inner core through the at least one mesh ceramic portion to the formation.

9. The method of claim 8, wherein the ceramic particles range in size from about 106 micrometers to about 2.36 millimeters.

10. The method of claim 8, wherein the ceramic particles are less than 2 micrometers.

11. A method for enhancing recovery of heavy oil from a formation, comprising the steps of:

suspending a downhole tool with a connector above a wellbore;

removeably lowering the downhole tool in the wellbore, the downhole tool comprising an inner core that is operable to allow the flow of fluid, an outer core comprising at least one mesh ceramic portion and at least one solid ceramic portion, and at least one electromagnetic antenna disposed between the inner core and outer core;

emitting electromagnetic radiation from the at least one electromagnetic antenna to heat the at least one mesh ceramic portion and the at least one solid ceramic portion to a temperature higher than the boiling point of the fluid;

injecting the fluid into the inner core;

flowing the fluid from the inner core through the at least one mesh ceramic portion to the formation; and converting the fluid to steam as it flows through the at least one mesh ceramic portion.

12. The method of claim 11, wherein the fluid is water.

13. The method of claim 11, wherein the step of heating the at least one mesh ceramic portion and the at least one solid ceramic portion comprises heating the at least one mesh ceramic portion and the at least one solid ceramic portion to at least about 1000° C.

14. The method of claim 11, wherein the step of emitting electromagnetic radiation comprises emitting electromagnetic radiation with frequency ranges from 300 MHz to 300 GHz.

15. The method of claim 11, further comprising:

placing production tubing in a second wellbore below the first wellbore;

reducing the viscosity of heavy oil located in the formation with the steam to produce a reduced viscosity heavy oil;

draining the reduced viscosity heavy oil to a region containing the second wellbore; and flowing the reduced viscosity heavy oil into the production tubing to be produced from the formation.

16. The method of claim 11, wherein the at least one ceramic portion comprises silica, alumina, magnesium oxide, potassium, iron III oxide, calcium oxide, sodium oxide, and titanium oxide.

17. The method of claim 11, further comprising:

injecting a proppant comprising ceramic particles into the inner core; and heating the ceramic particles in the proppant with the electromagnetic radiation from the at least one electromagnetic antenna as the proppant flows from the inner core through the at least one mesh ceramic portion to the formation.

18. The method of claim 17, wherein the ceramic particles range in size from about 106 micrometers to about 2.36 millimeters.

19. The method of claim 17, wherein the ceramic particles are less than 2 micrometers.

* * * * *